US005187491A

United States Patent [19]

Schuss et al.

[11] Patent Number: 5,187,491

[45] Date of Patent: Feb. 16, 1993

[54] LOW SIDELOBES ANTENNA

[75] Inventors: Jack J. Schuss, Sharon; Jeffrey C. Upton; Edward A. Geyh, both of Groton; Kaichiang Chang, Northborough, all of Mass.

[73] Assignee: Raytheon Company, Lexington, Mass.

[21] Appl. No.: 647,393

[22] Filed: Jan. 29, 1991

[51] Int. Cl.[5] ..... H01Q 13/00

[52] U.S. Cl. ..... 343/781 R; 343/840

[58] Field of Search ..... 343/781 R, 840, 887, 343/912

[56] References Cited

U.S. PATENT DOCUMENTS

| | | | |
|---|---|---|---|
| 2,940,078 | 6/1960 | Bodmer et al. | 343/781 R |
| 3,419,871 | 12/1968 | Cohen et al. | 343/781 R |
| 3,550,135 | 12/1970 | Bodmer | 343/781 R |
| 3,623,115 | 11/1971 | Schuttloffel | 343/781 R |
| 3,832,717 | 8/1974 | Taggart, Jr. | 343/840 |
| 3,969,731 | 7/1976 | Jenkins et al. | 343/840 |
| 4,122,446 | 10/1978 | Hansen | 343/786 |
| 5,003,321 | 3/1991 | Smith et al. | 343/781 R |

OTHER PUBLICATIONS

Michelson et al., "Terminal Doppler Weather Radar", Microwave Journal, Feb. 1990, pp. 139-148.

"A New Horn Antenna with Suppressed Sidelobes and Equal Beam-widths," P. D. Potter, Microwave Journal, vol. VI, pp. 195-202, Jun. 1963.

"Antenna Engineering Handbook", second edition, Richard C. Johnson and Henry Jasik, Editors, McGraw-Hill, Inc., 1983, Chapter 15.

"Radar Handbook," second edition, Merrill I. Skolnik, McGraw-Hill Inc., 1990, Chapter 6.

*Primary Examiner*—Rolf Hille

*Assistant Examiner*—Hoanganh Le

*Attorney, Agent, or Firm*—Walter F. Dawson; Richard M. Sharkansky

[57] ABSTRACT

A radar type center fed antenna comprising a small radiating horn supported at the focal point of a parabolic reflector by three struts which are oriented to minimize the parallel polarization scattering and which have a low scattering ogive cross-section. The horn is mounted at the vertex of the parabolic surface and the intersection of the three struts using a bracket that provides minimal blockage. The struts are attached to the perimeter of the reflector. One strut having a feed waveguide is attached to the top-center of the reflector and the other two are attached at points on either side of the bottom-center at thirty degree angles to the vertical plane. The strut shape and feed-horn supporting and attaching arrangement and the integration of the feed waveguide into one of the struts results in a very low sidelobe antenna that produces a far-field pattern that has very low forward scattering due to feed and strut blockage.

7 Claims, 5 Drawing Sheets

LOW SIDELOBES ANTENNA

BACKGROUND OF THE INVENTION

This invention relates to antennas and in particular to a center fed reflector radar antenna having very low sidelobes.

One of the most widely used microwave antennas for radar is a parabolic reflector, which is a device that radiates and focuses electromagnetic energy by use of the shape of the curve of a parabola. The typical design of a radar system with a parabolic reflector involves an individual radiator that transmits energy toward the reflector where it is then directed toward a target. Reflected energy from the target returns to the parabolic reflector where it is coupled to a receiver for processing. The lobe structure of the antenna radiation pattern outside the major lobe (main beam) region usually consists of a large number of minor lobes, of which those adjacent to the main beam are sidelobes. Sidelobes can be a source of problems for a radar system. In the transmit mode they represent wasted radiated power illuminating directions other than the desired main beam direction, and in the receive mode they permit energy from undesired directions to enter the system. The text "Radar Handbook", second edition, Merrill Skolnik, McGraw-Hill Inc., 1990, provides an overview of the art of reflector antennas in Chapter 6. It is well known in the antenna art that a center fed reflector antenna is limited in terms of the minimization of sidelobe levels due to forward scattered energy from the feed and its support structure.

In the prior art, the use of struts or spars with ogival cross-sections to provide a substantial reduction in "backscatter" in an antenna is shown and described in U.S. Pat. No. 3,419,371, issued Dec. 31, 1968, to Albert Cohen et al. and assigned to Communication Structures, Inc. The descriptive term ogival is used to describe a geometric figure formed by an arc drawn symmetrically on appropriate sides of its chord which looks like an oval with pointed ends. The spars are positioned so that one pointed end or edge faces the radar reflector and the opposite end or edge faces away from the reflector. Electromagnetic waves upon striking one of the sharp edges apparently flow around the surface of the spar as traveling waves and meet again at the opposite edge. The amount of backscattering disruption that occurs depends on the shape of the ogive and the path length of the traveling wave component. Using a method of moment analysis, the backscattering can be minimized by varying the ogive shape.

The use of a dual mode conical horn to suppress sidelobes is described in an article entitled "A New Antenna With Suppressed Sidelobes" by P. D. Potter, Microwave Journal, June 1963, pp. 195–202. The dual mode conical horn utilizes a conical horn excited at the throat region with a step discontinuity in both the dominant $TE_{11}$ mode and the higher-order $TM_{11}$ mode. These two modes are then excited in the horn aperture with the appropriate relative amplitude and phase to effect sidelobe suppression and beamwidth equalization. A stepless dual mode horn which also converts $TE_{11}$ to $TM_{11}$ energy in a horn is described in the text "Antenna Engineering Handbook", (second edition), Richard C. Johnson and Henry Jasik, Editors, McGraw-Hill, Inc., 1984, Chapter 15.

Typically the realization of low sidelobes in reflector antennas is achieved through the use of offset reflector configurations. The intent is to remove the scattering blockage of the feed and struts from in front of the radiating aperture of the reflector. Unfortunately, the manufacturing costs of the offset configurations are greater than for the center fed reflector approach. Prior art experience with center fed reflector antennas has indicated sidelobe levels of −25 dB or greater with respect to the main lobe amplitude.

SUMMARY OF THE INVENTION

Accordingly, it is therefore an object of this invention to provide a low cost radar antenna having very low sidelobes using a center fed reflector antenna.

It is a further object of this invention to provide a very low sidelobe, low cost antenna using the combination of a center fed reflector, dual mode feedhorn, ogival cross-section struts oriented to minimize scattering and a waveguide feed enclosed in one of the struts.

The objects are further accomplished by providing an antenna comprising means for collimating electromagnetic energy, means for illuminating the collimating means with the electromagnetic energy, means for positioning the illuminating means in front of and at the center of the collimating means, the positioning means having a cross-section for minimizing scattering, the positioning means having a lower portion oriented to minimize scattering by maximizing the perpendicularity of the positioning means relative to an electric field (E) of the antenna and to provide structural support for the illuminating means, and means disposed within an upper portion of the positioning means for providing the electromagnetic energy to the illuminating means. The collimating means comprises a center fed parabolic reflector. The illuminating means provides an illumination taper across the parabolic reflector surface. The positioning means comprises strut means, each of the strut means having an ogival cross-section for minimizing the scattering. The positioning means comprises an upper strut which includes a waveguide means and two lower struts, the lower struts being oriented approximately 30 degrees on each side of a vertical plane through the collimating means. The illuminating means comprises a dual mode feedhorn.

The objects are further accomplished by an antenna comprising a center parabolic reflector for collimating radio frequency energy, a dual mode feedhorn for illuminating the reflector with the radio frequency energy, strut means, having an ogival cross-section to minimize scattering, for positioning the feedhorn in front of the reflector at a vertex of said parabolic reflector and intersection of the strut means, the lower portion of the strut means being oriented to minimize scattering by maximizing the perpendicularity of the strut means relative to an electric field (E) of the antenna and to provide structural support for the feedhorn, and a waveguide disposed within an upper portion of the strut means for providing the radio frequency energy to the feedhorn. The reflector comprises a plurality of identical sections. The strut means comprises an upper strut which includes said waveguide and two lower struts, the lower struts being oriented approximately 30 degrees on each side of a vertical plane through the reflector.

The objects are further accomplished by a method of providing a center fed reflector antenna having very low sidelobes comprising the steps of collimating electromagnetic energy with the antenna reflector, illuminating the reflector with a dual mode feedhorn for providing the electromagnetic energy, positioning the illuminating means in front of and at the center of the reflector with strut means, the strut means having an ogival cross-section to minimize scattering, orienting the lower portion of the strut means to minimize scattering by maximizing the perpendicularity of the strut means relative to an electric field (E) of the antenna and to provide structural support for the feedhorn, and disposing a waveguide within an upper portion of the strut means for providing the electromagnetic energy to the feedhorn. The step of orienting the lower portion of the strut means further comprises the step of orienting two lower struts of the strut means approximately 30 degrees on each side of a vertical plane through the reflector.

BRIEF DESCRIPTION OF THE DRAWINGS

Other and further features and advantages of the invention will become apparent in connection with the accompany drawings wherein.

DESCRIPTION OF THE PREFERRED EMBODIMENT

Figure 1:
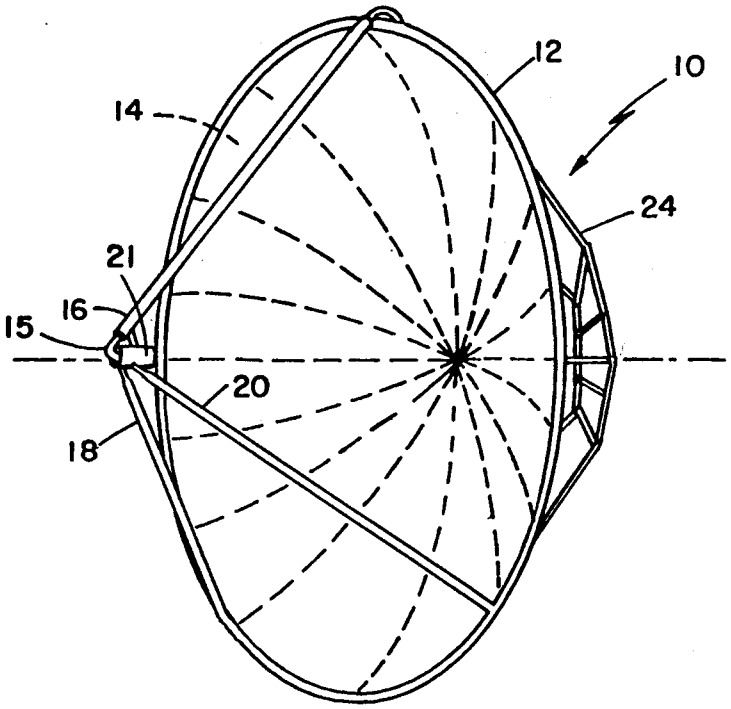
FIG. 1 is a pictorial view of a center fed reflector antenna in accordance with the invention.

Referring to FIG. 1, there is shown a pictorial view of a very low sidelobe, center fed parabolic reflector antenna 10 used in a weather radar system comprising a reflector 12, support structure 24 for such reflector 10, a dual mode feedhorn assembly 21 and three ogival shaped struts 16, 18, 20, for positioning the feedhorn assembly 21 in front of the reflector 12 and on a center line extending through the center of the reflector 12. Table 1 lists the main parameters of this relatively low cost antenna 10. The invention of antenna 10 accepts the presence of a certain amount of scattering due to the feedhorn assembly 21 and struts 16, 18, 20 blockage, but achieves the advantageous minimization of sidelobes by a combination of the following: first, the amount of blockage from feedhorn assembly 21 and struts 16, 18, 20 is minimized; second, the struts 16,18, 20 cross-section is shaped to minimize forward scattering, particularly the scattering due to an incident electric field (E) perpendicular to the strut orientation; third, the struts 16, 18, 20 are oriented to maximize perpendicularity with respect to the electric field polarization of the antenna 10 while maintaining mechanical integrity of the feedhorn assembly 21 and struts 16, 18, 20. This particular combination of elements produces such advantageous results that feed/strut blockage and scattering is sufficiently low to render the performance of such a low cost center fed reflector antenna 10 equivalent to an offset reflector antenna at a greatly reduced cost.

TABLE 1

| TYPE | CENTER-FED PARABOLIC REFLECTOR |
|---|---|
| FREQUENCY | 5.60–5.65 GHz |
| DIAMETER | 25 FEET |
| FOCAL LENGTH | 11.25 FEET |
| SURFACE TOLERANCE | 0.025 IN RMS |
| STRUTS | THREE; OGIVE CROSS SECTION |
| BEAMWIDTH | 0.547 ± 0.018 DEGREES |
| NEAR-IN SIDELOBES (±1 TO ±5 DEGREES) | −29.2 dB AT 99% CONFIDENCE |
| FAR-OUT SIDELOBES (±5 TO ±180 DEGREES) | −42.6 dB AT 95% CONFIDENCE |
| POLARIZATION | LINEAR HORIZONTAL |
| CROSS-POLARIZATION (dB) (IN MAIN BEAM) | < −39 |
| CROSS-POLARIZATION (dB) (OUTSIDE MAIN BEAM) | < −48.2 |

Figure 9:
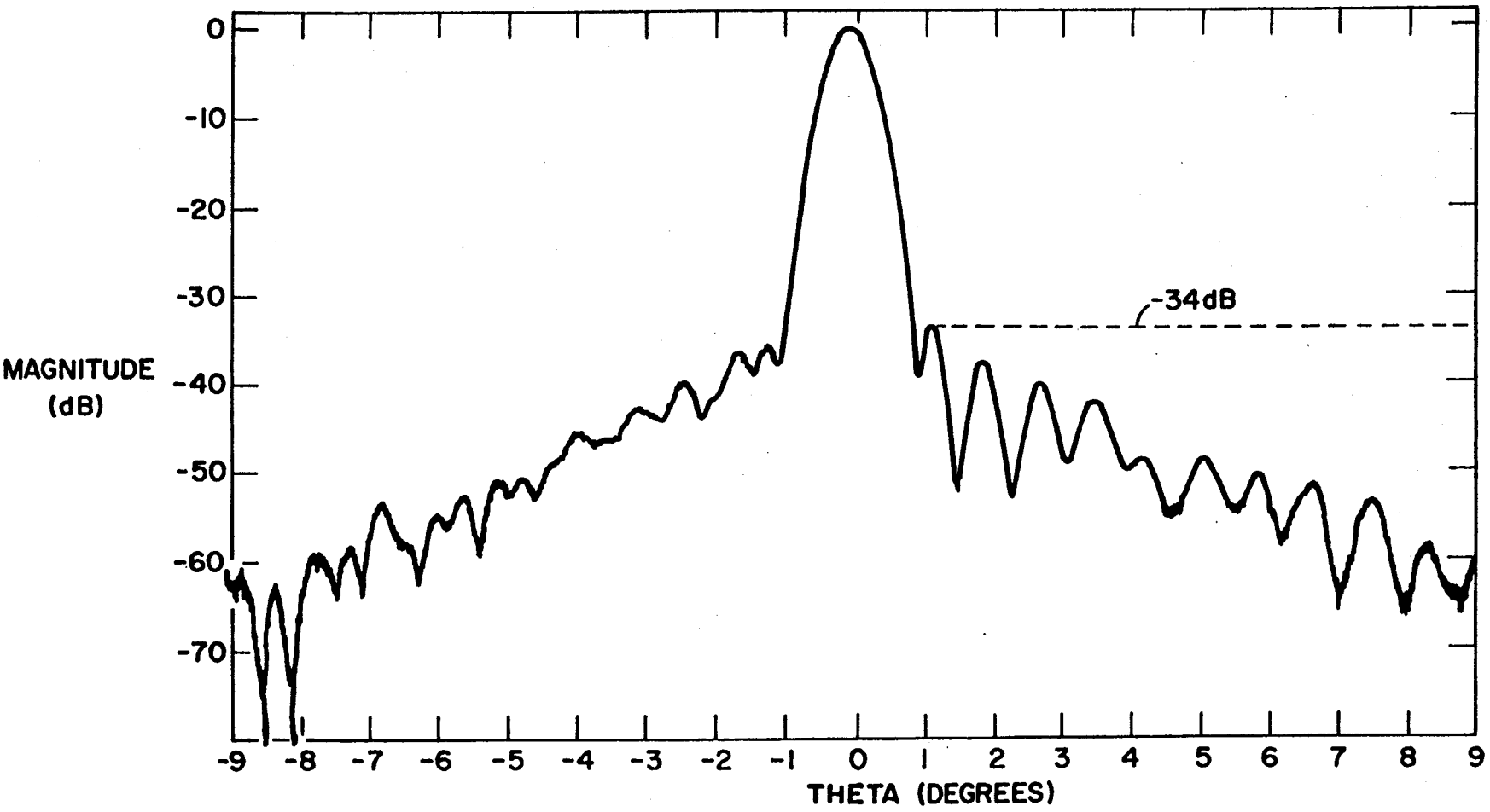
FIG. 9 is a plot of the measured far field radiation pattern of the invention along the H plane showing a peak sidelobe of −34 dB.

The measured peak sidelobe of antenna 10 is −34 dB below the peak of the main beam (FIG. 9).

Figure 2:
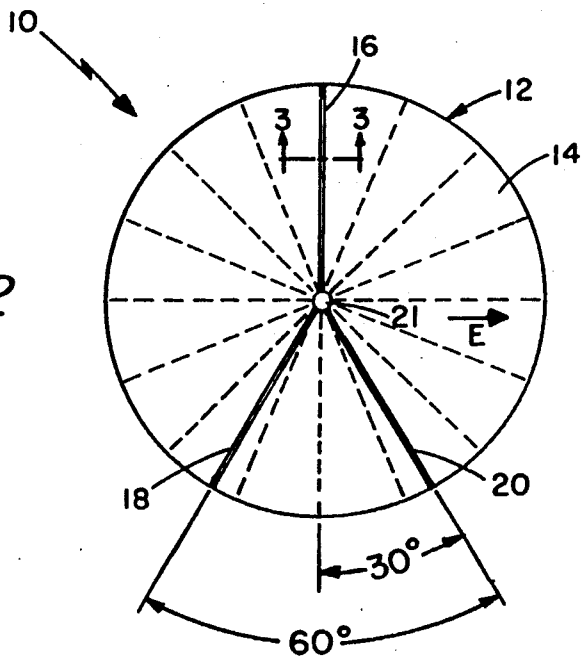
FIG. 2 is a front view of the antenna showing an aligning of two lower struts at a 30° angle to the vertical.
Figure 4:
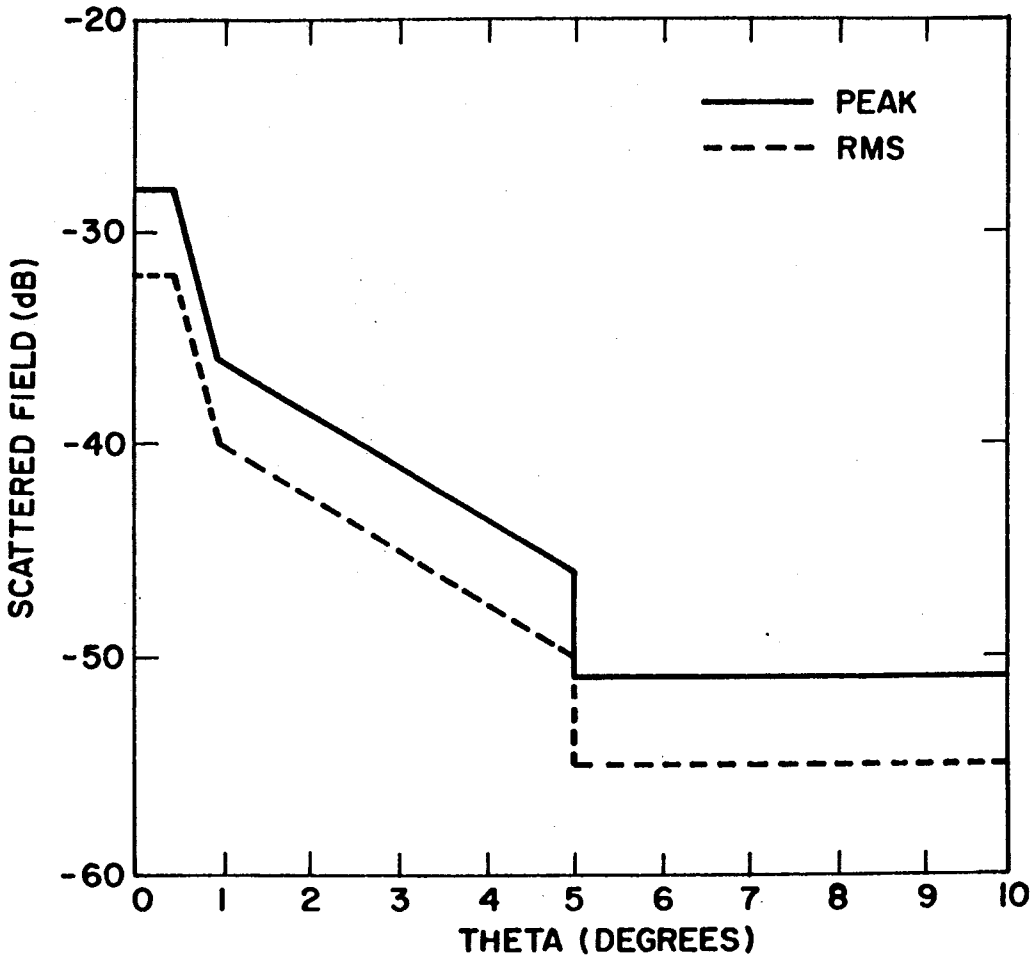
FIG. 4 is a plot of the reflector surface error scattering specification.

Referring now to FIG. 2 and FIG. 4, FIG. 2 is a front view of the antenna 10. The reflector 12 comprises a plurality of identical sections called petals 14. The reflector surface error scattering spectrum is specified in addition to the RMS surface error of 0.025 inches, to assure that an in-specification reflector surface results in sidelobes that meet the design levels. FIG. 4 specifies the angular spectrum of RF power scattered from the reflector 12 surface, which is a function of both the local surface error or deviation from that of a perfect parabola, and the periodicity of this surface error. This spectrum is calculated by transforming the local surface error into a phase error, and Fourier transforming this error function into the antenna angular space. This scattered field will add, in some phase, to the error free field of the reflector antenna, and is specified so that there is a high confidence that the error free field will not be sufficiently degraded by the scattered field so as to fall below specifications. Table 2 and Table 3 show how such a scattering budget can be formulated so that specifications are met with high confidence levels.

TABLE 2

| PEAK NEAR-IN SIDELOBE LEVEL PARAMETERS | COMPUTATION (dB) |
|---|---|
| REFLECTOR WITH FEED, STRUT SCATTERING | −34.2 |
| PANEL GAP SCATTERING | −63.9 |
| TOTAL (VOLTAGE SUMMATION) | −33.9 |
| RMS SCATTERING LEVEL AT Θ = 1 DEG FROM 0.025 INCH RMS REFLECTOR SURFACE ERRORS | −40.0 |
| TOTAL (99% CONFIDENCE) | −28.5 |

TABLE 3

| PEAK FAR-OUT SIDELOBE LEVEL PARAMETERS | COMPUTATION (dB) |
|---|---|
| REFLECTOR WITH FEED, STRUT SCATTERING | −47.4 |

TABLE 3-continued

| PEAK FAR-OUT SIDELOBE LEVEL PARAMETERS | COMPUTATION (dB) |
|---|---|
| PANEL GAP SCATTERING | −64.3 |
| TOTAL (VOLTAGE SUMMATION) | −46.2 |
| RMS SCATTERING LEVEL AT Θ = 5.5 DEG FROM 0.025 INCH RMS REFLECTOR SURF ERRORS | −55.0 |
| TOTAL (99% CONFIDENCE) | −42.9 |

The surface error scattered field specification of FIG. 4 then defines both the distribution and magnitude of the surface errors on the reflector 12. The upper strut 16 comprises a waveguide 15 constructed within the strut itself. The two lower struts 18 and 20 are oriented in a manner to support the feedhorn 22 and also to minimize scattering of the microwave energy. In order to satisfy both requirements, the struts 18 and 20 are each positioned at the rim of the reflector 12, 30 degrees on each side of a vertical plane through the reflector, resulting in a subtended angle of 60 degrees between the pair of struts 18 and 20. Also, the struts 18, 20 are 60 degrees relative to an electric field (E) to minimize scattering of the horizontally polarized energy by maximizing the perpendicularity of the struts 18 and 20 relative to the E-field of the antenna 10.

Figure 3:
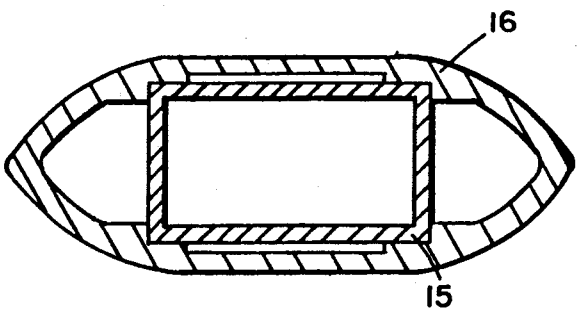
FIG. 3 is a cross-section of an ogival strut showing a waveguide enclosed therein.

Referring now to FIG. 1 and FIG. 3, a cross-section of the upper ogival strut 16 is shown in FIG. 3 which reveals the waveguide 15 included therein for feeding the microwave energy to the feedhorn assembly 21 as shown in FIG. 1. The lower struts 18 and 20 comprise the same ogival shape but do not need the waveguide. Each of the struts 16, 18, 20 has the ogival cross-section that results in a very low scattering cross-section for perpendicular polarization. The struts are positioned so that one pointed end or edge faces the radar reflector 12 and the opposite end or edge faces away from the reflector 12. The parallel polarization scattering cross-section remains large but it is reduced by aligning the lower struts to 30 degrees off the vertical (H-plane) as described above which reduces the parallel E-field component by the sine 30 degrees or 6 dB. Since the upper strut 16 includes the feed waveguide 15, such waveguide 15 does not contribute to scattering.

Figure 5:
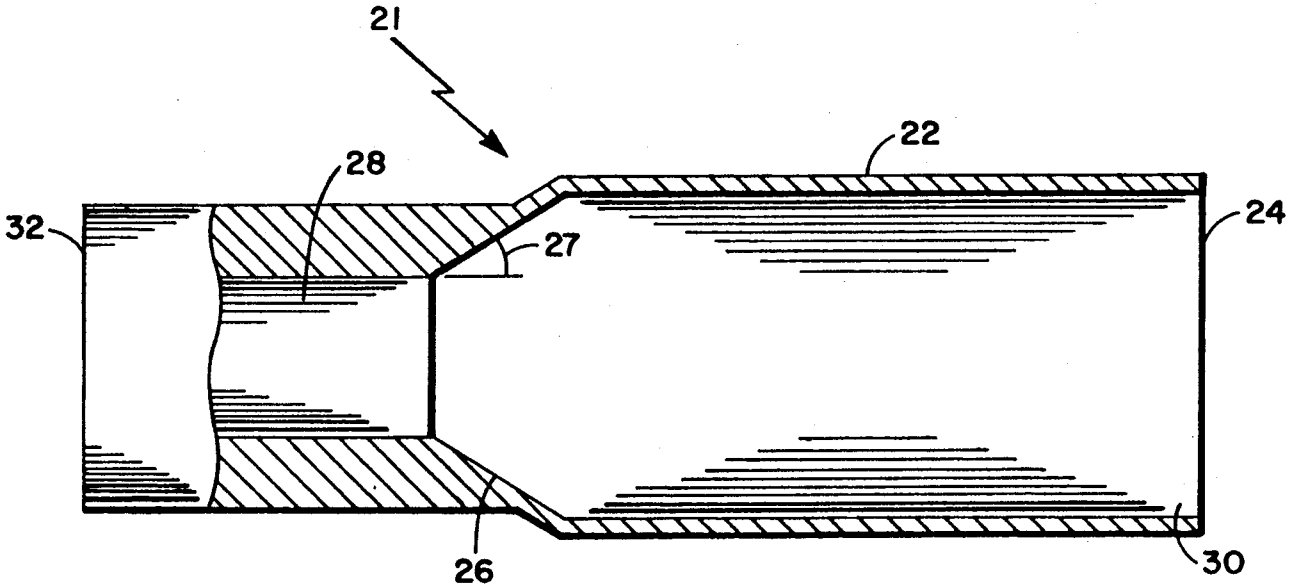
FIG. 5 is a cut-away side view of a dual mode feedhorn assembly.
Figure 6:
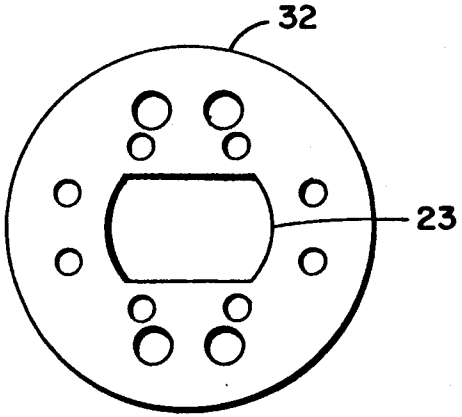
FIG. 6 is an end view of the waveguide input of the feedhorn assembly.

Referring now to FIGS. 5 and 6, FIG. 5 is a cut away side view of the dual mode feedhorn assembly 21 and FIG. 6 is an end view of the waveguide transition 32. The feedhorn assembly 21 comprises the waveguide transition 32 and the feedhorn 22. The feedhorn 22 is a dual mode Potter type horn, optimized to generate a large edge taper at the edge of reflector 12. Such a taper is necessary to produce the desired low sidelobe antenna pattern. The Potter type horn 22 yields equal E and H plane beamwidths, and it is a low blockage and low cost feedhorn ideally suited for narrowband applications. The waveguide transition 32 shown in FIG. 6 is a single step design which provides a good electrical match between an input rectangular cross-section waveguide 15 (FIG. 3) and an output circular cross-section waveguide 30. The waveguide transition cross-section 23 is a truncated circle with a width of 1.168±0.004 inches and a radius of 1.740 inches. The diameter of output circular cross-section waveguide 28 which is also 1.740 inches is specified to allow only the dominant $TE_{11}$ circular waveguide mode to propagate. The adjoining tapered region 26 generates higher order waveguide modes. A 32.3 ±0.2 degree taper angle 27 was selected to control the amount of energy coupled into the higher order modes. The larger diameter output circular waveguide 30 is sized to allow only the next highest $TM_{11}$ waveguide mode to propagate; its diameter is 3.483 inches. The length of such waveguide 30 is 6.60 ±0.01 inches, and is adjusted to achieve the desired phase relationship between the field distributions of the two modes at the horn aperture 24.

Figure 7:
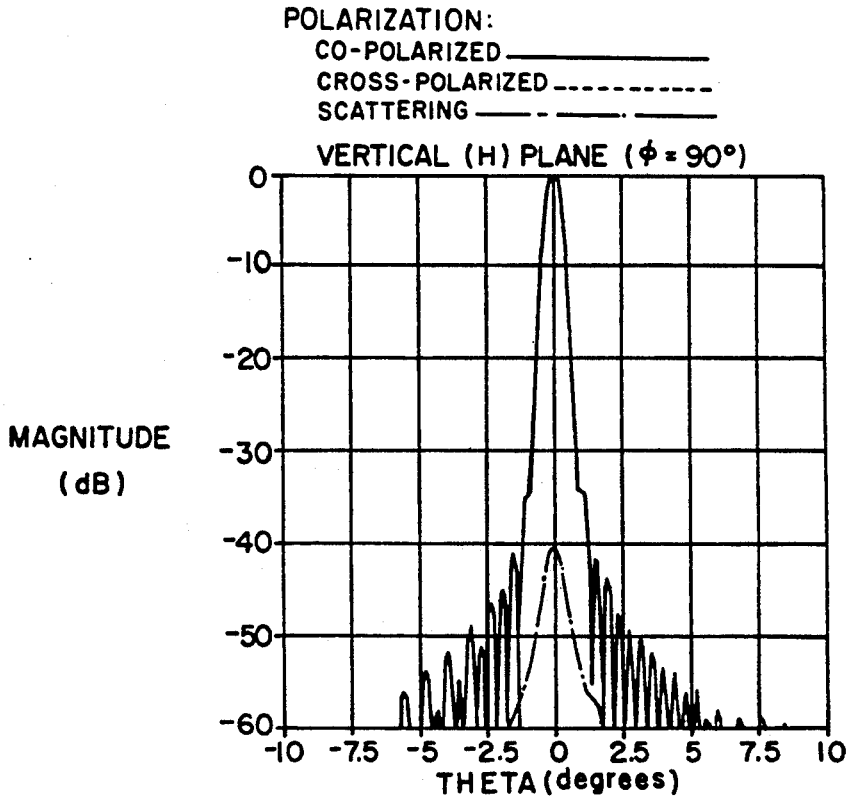
FIG. 7 is a plot of a computed far field radiation pattern through the H plane showing peak antenna sidelobes within a ±5 degree range; it also shows the cross-polarized field as well as the scattered field due to the feedhorn and struts.
Figure 8:
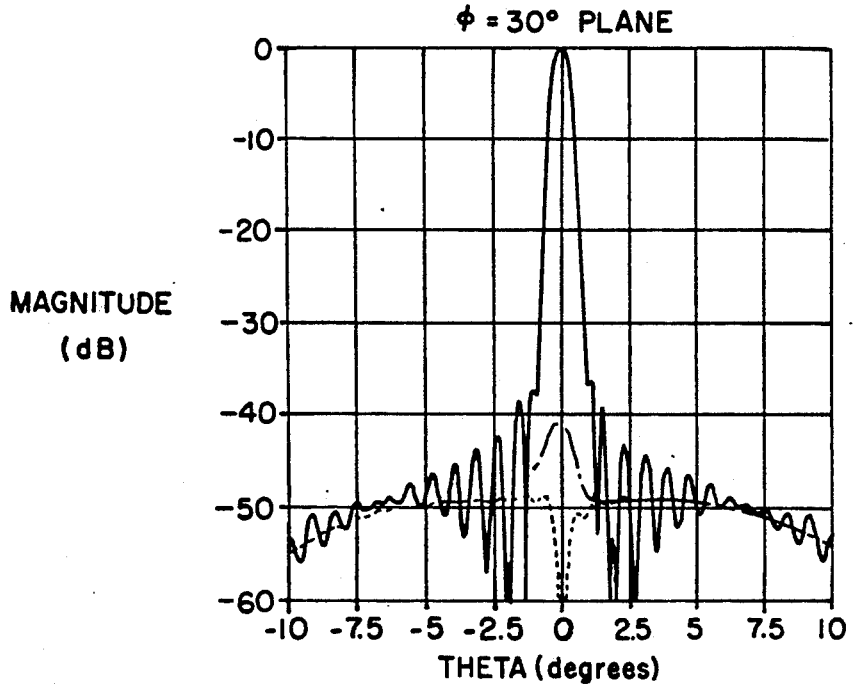
FIG. 8 is a plot of a computed far field radiation pattern through the 30 degree plane showing peak antenna sidelobes for angles outside the ±5 degree range; it also shows the cross-polarized field as well as the scattered field due to the feedhorn and struts.

Referring now to FIG. 7 and FIG. 8, FIG. 7 is a plot of a computed far field radiation pattern of antenna 10 through the H plane showing the peak antenna sidelobe of −34.2 dB within a ±5 degree range; also shown is the cross-polarized fields as well as the scattered field due to the feedhorn assembly 21 and struts 16, 18, 20. FIG. 8 is a plot of a computed far field radiation patterns through the 30 degrees plane showing the peak antenna sidelobe of −47.4 dB for angles outside the ±5 degree range; also shown is the cross-polarized field as well as the scattered field due to the feedhorn assembly 21 and struts 16, 18, 20. The radiation patterns of FIGS. 7 and 8, respectively, depict the sidelobe distributions which contain the computed peak sidelobes in the near-in and far-out regions. The near-in region is defined as the angular region within ±5 degrees of the main beam. Because the intent of this invention was to minimize the co-polarized scattered field due to the strut and horn blockage, the scattered field is plotted separately. The total co-polarized field is the voltage sum of the unblocked reflector radiated field and the scattered fields. In the far-out region it is important to note that the pattern cut at 30 degrees is selected because it is orthogonal to one of the two lower struts 18 and 20. Along this cut the scattered field due to the struts is very broad in angular extent and drops very slowly in magnitude. As a consequence, the co-polarized sidelobes fall off very slowly and this plane contains the peak far-out sidelobes.

Referring now to FIG. 9, a plot of a measured far field radiation pattern of the preferred embodiment antenna 10 along the H plane is shown. The combination of the low scattering feedhorn assembly 21 and struts 16, 18, 20 structure and orientation with a low sidelobe Potter type dual mode feedhorn 22, which introduces a symmetric low sidelobe amplitude illumination on the reflector produces an ultra-low sidelobe reflector antenna 10, having peak sidelobe levels of −34 dB below the peak of the main beam.

This concludes the description of the preferred embodiment of the invention. However, many modifications and alterations will be obvious to one of ordinary skill in the art without departing from the spirit and scope of the inventive concept. For example, an alternate embodiment for achieving a low cost and low sidelobe antenna includes strut means having a single lower vertical strut to replace struts 18 and 20 and using guide wires to stabilize the strut and feedhorn and to reduce scattering. Therefore, it is intended that the scope of this invention be limited only by the appended claims which follow.

What is claimed is:

1. An antenna comprising:

means for collimating electromagnetic energy;

means for illuminating said collimating means with said electromagnetic energy;

means for positioning said illuminating means in front of and at the center of said collimating means, said positioning means comprises three struts for supporting said illuminating means, each of said struts having an ogival cross-section for producing minimal scattering;

two lower struts of said positioning means being oriented approximately 30 degrees on each side of a vertical plane through said collimating means, said orienting of said lower struts maximizing the perpendicularity of said positioning means relative to an electric field (E) of said antenna thereby minimizing said electric field scattering and providing structural support for said illuminating feed means; and waveguide means disposed within an upper strut of said positioning means for providing said electromagnetic energy to said illuminating means, said upper strut being perpendicular to said electric field.

2. The antenna as recited in claim 1 wherein:

said collimating means comprises a center fed parabolic reflector.

3. The antenna as recited in claim 2 wherein:

said illuminating means provides an illumination taper across said parabolic reflector surface.

4. The antenna as recited in claim 1 wherein said illuminating means comprises a dual mode feedhorn.

5. An antenna comprising:

a center parabolic reflector for collimating radio frequency energy;

a dual mode feed horn for illuminating said reflector with said radio frequency energy;

three struts, each having an ogival cross-section to produce minimal electric field scattering, for positioning said feed horn in front of said reflector at a vertex of said parabolic reflector and intersection of said three struts;

two lower struts of said three struts being oriented approximately 30 degrees on each side of a vertical plane through said parabolic reflector, said orienting of said lower struts maximizing the perpendicularity of said strut means relative to an electric field (E) of said antenna thereby minimizing said electric field scattering and providing structural support for said feed horn; and a waveguide disposed within an upper strut of said three struts for providing said radio frequency energy to said feed horn, said upper strut being perpendicular to said electric field.

6. The antenna as recited in claim 5 wherein:

said reflector comprises a plurality of identical sections.

7. A method of providing a center fed reflector antenna having very low sidelobes comprising the steps of:

collimating electromagnetic energy with said reflector antenna;

illuminating said reflector antenna with a dual mode feed horn for providing said electromagnetic energy;

positioning said dual mode feed horn in front of and at the center of said reflector with three struts, said struts having an ogival cross-section to produce minimal electric field scattering;

orienting two lower struts of said three struts approximately 30 degrees on each side of a vertical plane through said reflector antenna, said orienting of said lower struts maximizing the perpendicularity of said lower struts relative to an electric field (E) of said antenna thereby minimizing said electric field scattering and providing structural support for said feed horn; and disposing a waveguide within an upper strut of said three struts for providing said electromagnetic energy to said feed horn, said upper strut being perpendicular to said electric field.

* * * * *